US008070244B2

(12) United States Patent
Dumenil

(10) Patent No.: US 8,070,244 B2
(45) Date of Patent: Dec. 6, 2011

(54) PRINTING MACHINE AND A METHOD OF PRINTING

(75) Inventor: François Dumenil, Chaumes en Brie (FR)

(73) Assignee: Machines Dubuit, Noisy le Grand (FR)

( * ) Notice: Subject to any disclaimer, the term of this patent is extended or adjusted under 35 U.S.C. 154(b) by 1012 days.

(21) Appl. No.: 11/934,119

(22) Filed: Nov. 2, 2007

(65) Prior Publication Data

US 2008/0264276 A1 Oct. 30, 2008

(30) Foreign Application Priority Data

Nov. 3, 2006 (FR) ..... 06 09633

(51) Int. Cl.

| | |
|---|---|
| ***B41J 3/00*** | (2006.01) |
| ***B41J 23/00*** | (2006.01) |
| ***B41J 2/15*** | (2006.01) |
| ***B41J 2/145*** | (2006.01) |

(52) U.S. Cl. ..... 347/2; 347/37; 347/38; 347/40

(58) Field of Classification Search ..... 347/2, 5, 347/6, 7, 8, 9, 12, 14, 16, 37, 38, 39, 40, 347/102

See application file for complete search history.

(56) References Cited

U.S. PATENT DOCUMENTS

| | | | | |
|---|---|---|---|---|
| 2,484,671 | A * | 10/1949 | Bauman | 101/115 |
| 2,690,118 | A * | 9/1954 | Schwartz et al. | 101/115 |
| 4,892,184 | A | 1/1990 | Vander Griendt et al. | |
| 5,031,527 | A * | 7/1991 | Eppinger | 101/115 |
| 5,136,938 | A * | 8/1992 | Pellegrina | 101/115 |
| 5,154,119 | A * | 10/1992 | Fuqua et al. | 101/115 |
| 5,361,694 | A * | 11/1994 | Dubuit | 101/115 |
| 5,444,469 | A | 8/1995 | Cowger | |
| 5,517,223 | A * | 5/1996 | Shin | 347/38 |
| 5,602,624 | A * | 2/1997 | Coburn et al. | 347/2 |
| 5,970,874 | A * | 10/1999 | Bill | 101/488 |
| 6,053,101 | A * | 4/2000 | Hix | 101/126 |
| 6,068,362 | A | 5/2000 | Dunand et al. | |
| 6,135,654 | A | 10/2000 | Jennel | |
| 6,145,979 | A * | 11/2000 | Caiger et al. | 347/102 |
| 6,154,232 | A * | 11/2000 | Hickman et al. | 347/40 |
| 6,164,199 | A * | 12/2000 | Dubuit et al. | 101/38.1 |
| 6,769,357 | B1 * | 8/2004 | Finan | 101/38.1 |
| 6,821,039 | B2 | 11/2004 | Lewis | |
| 7,060,969 | B2 * | 6/2006 | Uchiyama et al. | 250/231.16 |
| 7,231,873 | B2 * | 6/2007 | Macchi | 101/115 |
| 2004/0085425 | A1 | 5/2004 | Lewis | |
| 2005/0046648 | A1 * | 3/2005 | Dumenil | 347/2 |
| 2006/0092198 | A1 | 5/2006 | Conca et al. | |
| 2006/0249039 | A1 * | 11/2006 | Feldman et al. | 101/115 |

FOREIGN PATENT DOCUMENTS

| | | |
|---|---|---|
| AU | B-49552/81 | 10/1982 |
| FR | 2 755 900 | 5/1998 |
| GB | 2 379 191 | 3/2003 |

* cited by examiner

*Primary Examiner* — Stephen Meier
*Assistant Examiner* — Leonard S Liang
(74) *Attorney, Agent, or Firm* — Young & Thompson

(57) ABSTRACT

The invention relates to a printing machine comprising a support plate (42) and a printer unit (44) fastened to the support plate (42) to project ink onto articles for printing. The printer station includes at least one additional printer unit (46, 48, 50), and the printer units (44, 46, 48, 50) are arranged beside one another on a circle centered on the axis of rotation (B-B) of a mandrel (8), when the mandrel (8) is placed in its printing position. The invention also provides a method of printing.

20 Claims, 5 Drawing Sheets

PRINTING MACHINE AND A METHOD OF PRINTING

BACKGROUND OF THE INVENTION

1. Field of the Invention

The present invention relates to a machine for printing on articles that are substantially in the form of bodies of revolution.

2. Description of the Related Art

A printing machine of this type includes a turntable carrying mandrels on which the articles for printing are engaged, and a plurality of printer stations for printing different colors that are arranged beside one another around the turntable.

The turntable is adapted to move the articles from one printer station to another. The position of the article for printing is identified in an identification station. Thereafter, the article is moved by the turntable to face a first printer station suitable for projecting ink of one color onto the article in order to print a portion of the pattern for printing in said color. Thereafter, the article is moved by the turntable towards a second printer station suitable for projecting ink of another color in order to print another portion of the pattern for printing.

When a pattern for printing has two different colors juxtaposed, it is necessary for a portion of the pattern of one color not to be printed on a portion of the pattern of another color. Similarly, the portions that are of different colors must all be printed beside one another without any non-printed spaces appearing between them.

Nevertheless, it is difficult to guarantee the position of the article-carrier mandrel relative to the printer station, since it is not possible mechanically to displace the turntable from one printer station to another with great accuracy.

In addition, since each of the printer stations is directed towards the center of the turntable, the triggering of ink projection from each printer station must take account of the angle defined by each of the printer stations relative to the center of the turntable, because the orientation of the article is modified by said angle on going from one printer station to another.

Consequently, it is difficult to satisfy the accuracy requirements of the manufacturers of articles when using a printing machine of that type.

U.S. Pat. No. 6,135,654 describes printing apparatus having a conveyor for conveying articles and three print heads disposed facing the part along which the conveyor brings the articles. The articles are placed on guides suitable for rotating the articles about their axes of symmetry.

Nevertheless, the rotary drive applied to the articles is not accurate, and as a result the colors are sometimes offset relative to one another.

Document FR 2 755 900 describes a machine for printing strips of fabric at varying speeds. The machine is suitable for compensating deformation in the fabric. It has a fabric drive motor, print heads facing the fabric, a position encoder placed on the drive motor, a printing device arranged upstream from the print heads and suitable for printing marks on the fabric, and an optical system for reading the marks. The print heads are suitable for triggering printing on the fabric as a function of a signal delivered by the position encoder and as a function of the signal generated by the optical system.

SUMMARY OF THE INVENTION

The present invention seeks to propose a printing machine that presents printing of great accuracy.

To this end, the invention provides a printing machine, characterized in that the printer station includes at least one additional printer unit, and in that the printer units are arranged beside one another around a circle centered on the axis of rotation of a mandrel when the mandrel is placed in its printing position.

The invention also provides a method of printing on articles that are substantially in the form of bodies of revolution with the help of a printing machine of the above-specified type, the method being characterized in that it comprises a step of printing and simultaneously driving a mandrel in rotation about its axis of rotation by drive means, said mandrel being positioned in the same location while it is pivoting in a printing position, and while an article for printing carried by said mandrel is being printed on by said printer units.

The present invention relates to a machine for printing on articles that are substantially in the form of bodies of revolution, the machine comprising:

- a structure;
- mandrels for carrying articles for printing, each mandrel being suitable for being driven in rotation about an axis of rotation corresponding substantially to an axis of symmetry of the article for printing;
- drive means for driving the article for printing so as to cause the mandrels to be moved between transfer positions and at least one printing position;
- a turntable carrying the mandrels, the turntable being driven in rotation by the drive means;
- displacement means for moving the mandrels in a radial direction relative to the turntable to move the mandrels away from or towards the or each printer station, each mandrel being moved between at transfer positions and at least one printing position; and
- a printer station comprising a support plate and a printer unit fastened to the support plate to project ink onto the articles for printing.

BRIEF DESCRIPTION OF THE DRAWING FIGURES

The invention can be better understood on reading the following description given purely by way of example and made with reference to the drawings, in which.

DETAILED DESCRIPTION OF THE INVENTION

Figure 1:
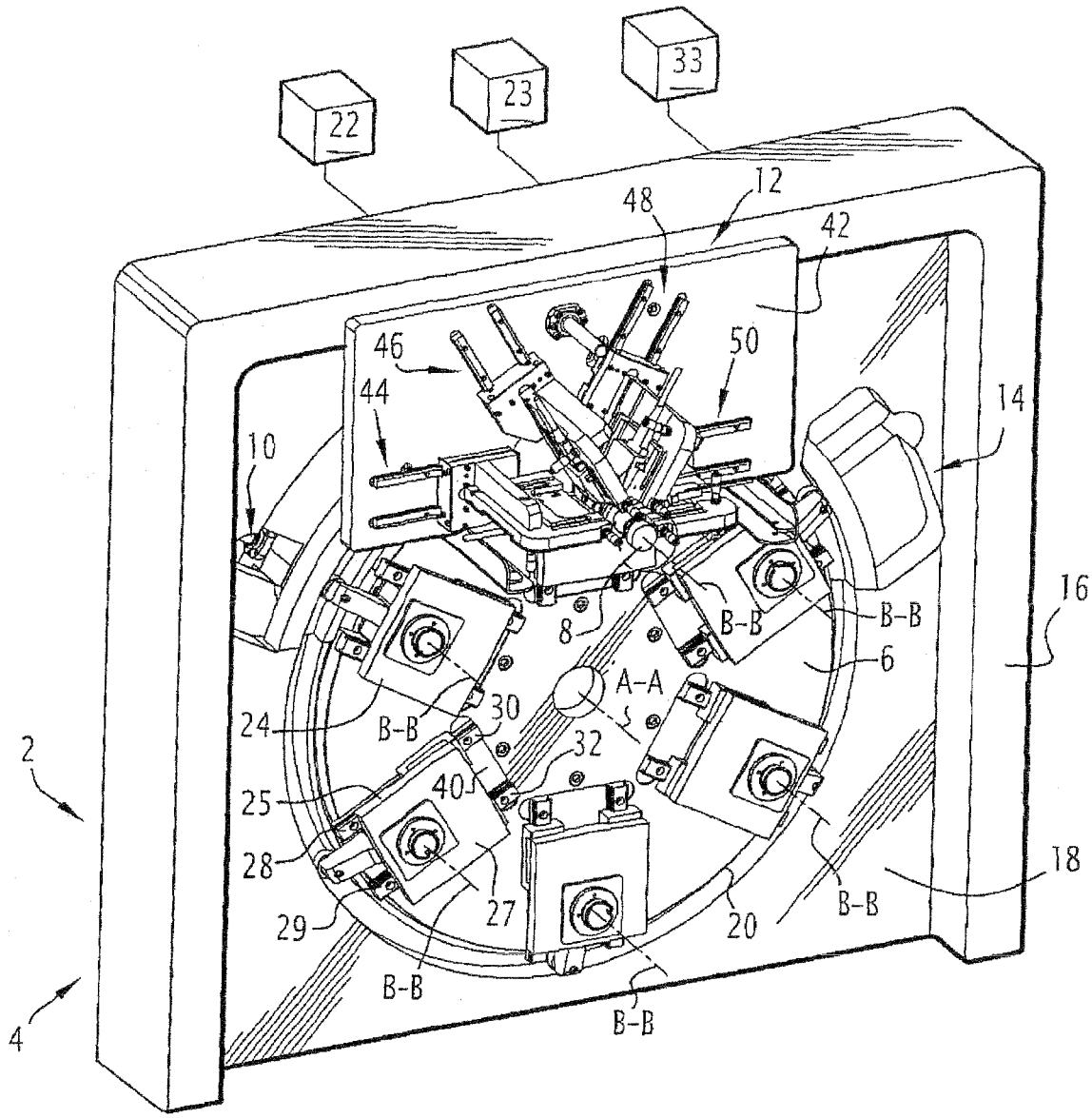
FIG. 1 is a perspective view of a printing machine having a printer station of the invention.

The printing machine 2 of the invention is shown in FIG. 1. It comprises a structure 4 supporting a turntable 6 fitted with mandrels 8 having axes B-B and treatment stations 10, 12, 14, one of these treatment stations being a printing station 12, distributed around the turntable 6. In FIG. 1, only one mandrel 8 is shown, the others being identified by their axes B-B.

The structure 4 is constituted by a rectangular metal frame 16 in which a separator wall 18 is secured. The separator wall 18 has an opening 20 through which the turntable 6 passes.

The wall 18 subdivides the machine 2 into a front portion supporting the treatment stations 10, 12, 14 and a rear portion in which the drive means for the machine 2 are mounted.

In the description below, the directions "front" and "rear" correspond to the orientation as defined above for the separator wall 18 and for the printing machine 2.

The turntable 6 is rotated about an axis of rotation A-A disposed at its center by rotary drive means 22 represented diagrammatically in FIG. 1.

The mandrels 8 are suitable for carrying the cylindrical articles for printing.

Each mandrel 8 is driven to rotate about an axis of rotation B-B parallel with the axis of rotation of the turntable A-A by rotary drive means 23.

The mandrels 8 are mounted on support carriages 24, disposed regularly around the perimeter of the front face 26 of the turntable 6.

Each support carriage 24, 25 is formed by a rectangular plate 27 fitted with two slideways 28, 29 fastened on each of the longitudinal edges of the plate 27 and co-operating with a pair of guide rails 30, 32 fastened on the front face of the turntable 6.

The guide rails 30, 32 extend in pairs in a radial direction relative to the turntable 6 so as to enable each carriage 24, 25 to move between a position in which the carriage is close to the axis A-A and a position in which the carriage is remote from said axis.

Each support carriage 24, 25 is suitable for being driven along the guide rails 30, 32 by displacement drive means 33 for moving each mandrel 8 towards or away from the treatment stations 10, 12, 14.

Radial cutouts 40 are formed between each pair of rails 30, 32 to pass a portion of the rotary drive means 23 for the mandrels 8 and a portion of the displacement drive means 33 for the mandrels 8.

Figure 2:
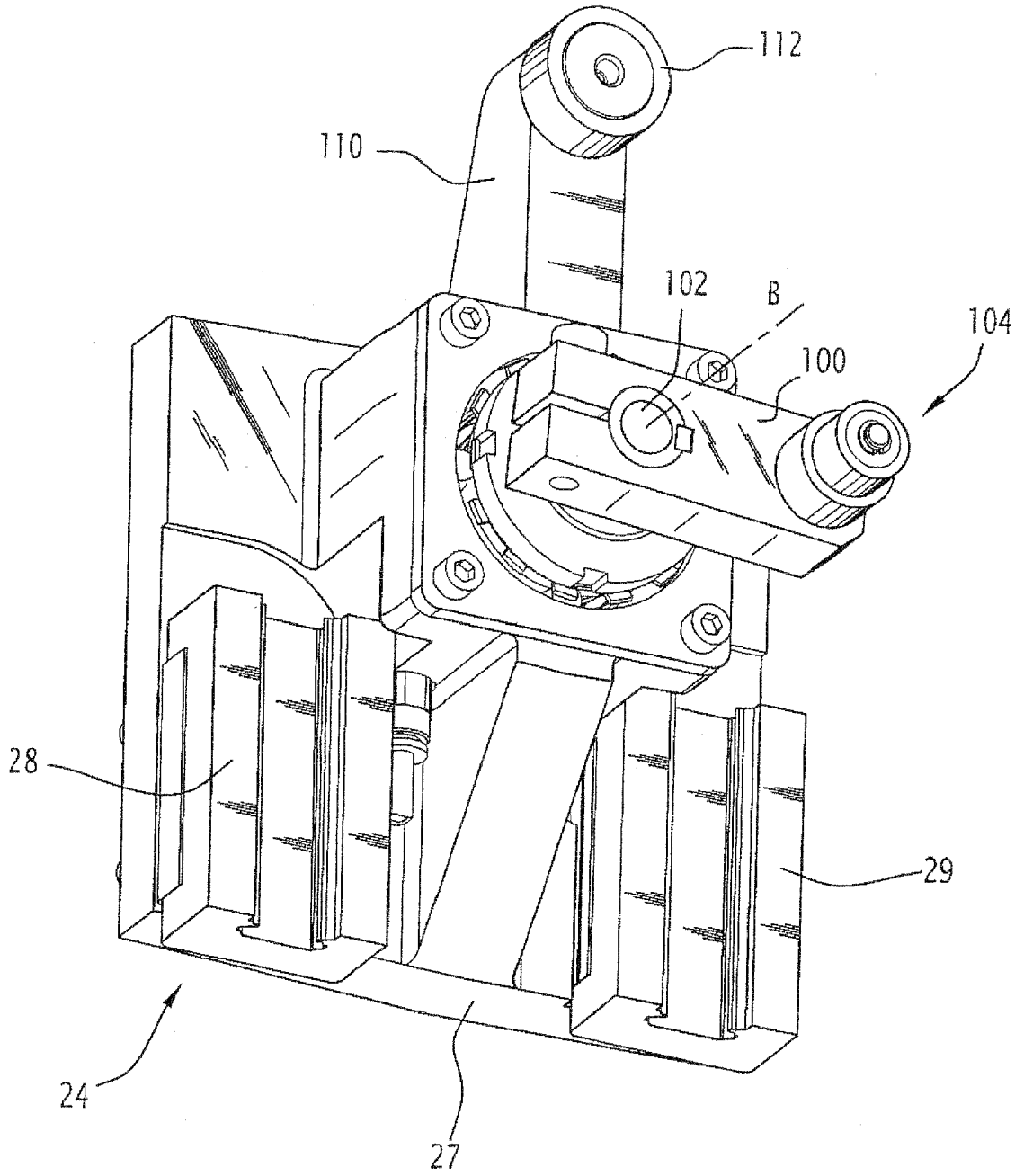
FIG. 2 is a perspective view of a mandrel-support carriage.

Each mandrel 8 is secured to a rotary drive crank 100 (cf. FIG. 2) that projects from a face of the plate 27 that is opposite from the face from which the mandrel 8 projects.

The drive crank 100 is formed by an arm having an orifice at one of its ends and a pair of follower wheels 104 at its other end. The orifice is suitable for fastening securely to a shaft 102 for driving the mandrel 8 in rotation.

Figure 3:
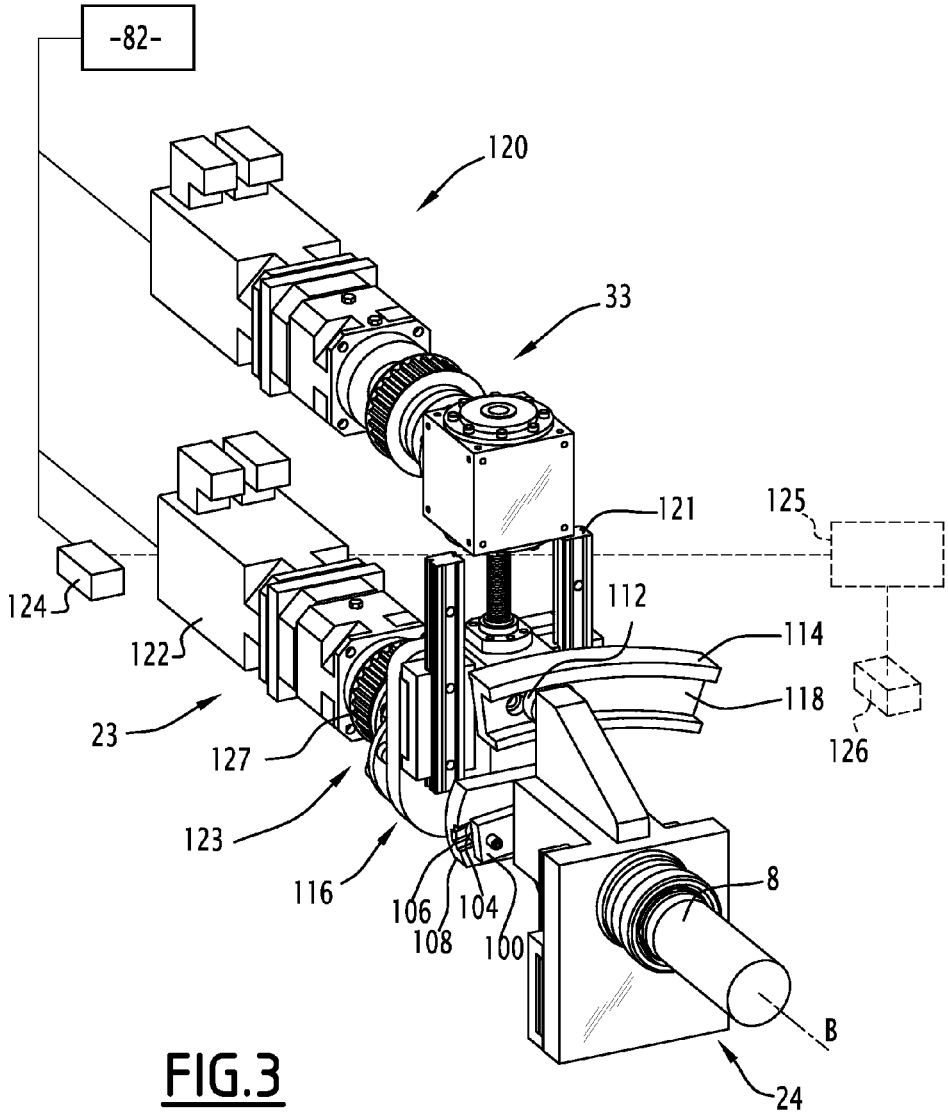
FIG. 3 is a perspective view of a mandrel-support carriage, a carriage carrier, and means for driving and moving mandrels in accordance with the invention.

As can be seen in FIG. 3, the pair of follower wheels 104 of the crank 100 is adapted to engage in a pair of grooves 106 in a drive guide 108 when the support carriage 24 is in register with a treatment station, and in a discontinuous groove of a cam path (not shown) when the support carriage 24 is between two treatment stations.

The drive guide 108 is suitable for driving the crank 100 in rotation about the axis B-B in order to turn the mandrel 8.

A traction projection 110 of the support carriage 24 extends from one side of the plate 27 of the support carriage. A cam wheel 112 fastened to the free end to the projection is adapted to be engaged in a channel 114 when the support carriage 24 is at a treatment station.

Each support carriage 24 is suitable for engaging in a carriage carrier 116 when it is in register with a treatment station.

The carriage carrier 116 is connected to the displacement means 33 for driving the carriage 24 in displacement along the rails 30, 32 of the turntable between a position close to the treatment station and a position remote therefrom.

The carriage carrier 116 is constituted by a rectangular base having a central protuberance on which the channel 114 is fastened. The slot 118 formed in the channel 114 is adapted to receive the cam wheel 112 of the support carriage in order to be capable of moving the carriage 24.

A displacement motor and gearbox unit 120 is securely fastened to the structure 4. It is suitable for causing the carriage carrier 116 to slide along rails 121 of the structure (shown in FIG. 3). The rails 121 extend radially relative to the turntable for moving the carriage 24.

The carriage carrier 116 is connected to the rotary drive means 23 in order to cause the mandrel 8 to turn when its support carriage 24 is in a position close to a treatment station.

The drive guide 108 is mounted to move in rotation on the front face of the carriage carrier 116. The guide 108 has a pair of grooves and is suitable for receiving the pair of follower wheels 104 of the crank 100 for causing the mandrel 8 to turn. The guide 108 is secured to a drive shaft that passes transversely through the base.

The drive shaft is fastened to a constant velocity coupling 127 without slack of the Schmidt coupling type and it is driven in rotation by a drive shaft 123 of a motor and gearbox unit 122 for driving the mandrels 8 in rotation. The motor and gearbox unit 122 is fastened to the structure.

The treatment stations 10, 12, 14 include a single printer station 12 of the invention and possibly a loading station, a flame treatment station, a varnishing 10 station, and an unloading station (not shown in FIG. 1).

Figure 4:
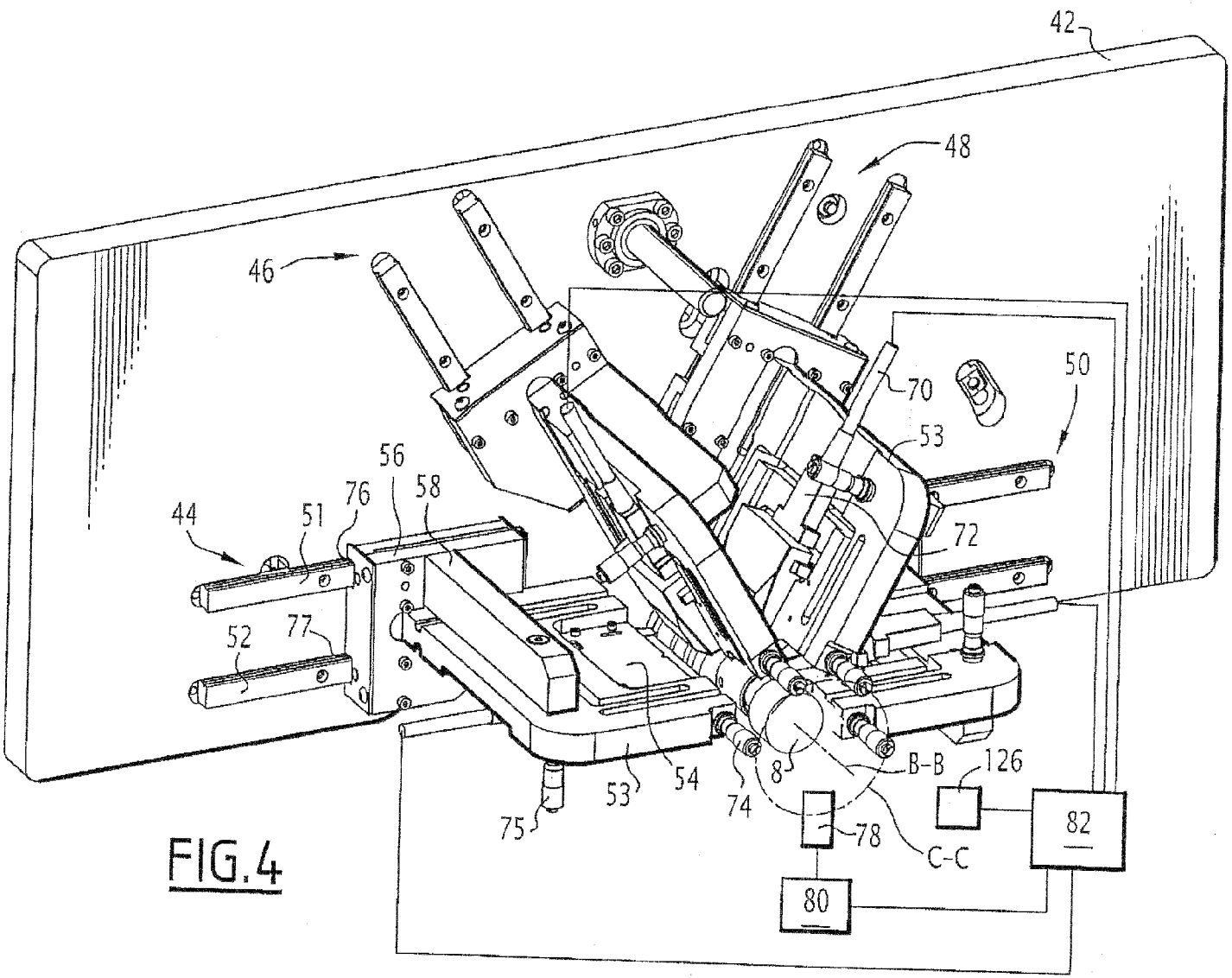
FIG. 4 is a perspective view of a printer station of the invention and of an article-carrier mandrel.

The printer station 12 of the invention, shown in FIG. 4, comprises a plate 42 designed to be fastened to the frame 16, and four printer units 44, 46, 48, and 50 mounted beside one another on the plate 42.

The plate 42 is provided with pairs of positioning rails 51, 52 extending radially about the center of a circular arc C-C disposed at a bottom side of the plate 42.

The printer units 44 to 50 are disposed beside one another along the circular arc C-C so that when the turntable 6 brings a mandrel 8 into register with the printer station 12 in a printing position, the axis of rotation B-B of the mandrel 8 coincides with the center of the circular arc C-C.

In this printing position of the mandrel 8, the printer units 44 to 50 all face the same mandrel 8.

The printer units 44 to 50 are disposed over a range of 180° around the article for printing when the mandrel 8 is in a printing position. Over this range, the printer units 44 to 50 are distributed regularly so as to form angles of 45° between one another.

Each printer unit 44 to 50 comprises a rectangular support plate 53, an ink jet print head 54 mounted on the plate 53, and a support base 56 for supporting the plate 52.

The print head 54 is substantially rectangular in shape, and it is positioned in a notch in one face of the plate 53. It is fed by an ink hose and by electric cables 70 secured to the print head 54 by a connector 72.

Each print head 54 is fed with a different color. Generally, three of the print heads are fed with ink of a primary color, and one of the print heads is fed with black ink.

Each printer unit 44 to 50 also has micrometer screws 74, 75 suitable for adjusting the orientation of each print head 54 in a direction that is tangential to the circular arc C-C and in the direction of the axis B-B.

Each base 56 presents a rectangular front main face for holding the support plate 53 and a rear main face fitted with slideways 76, 77 that co-operate with the positioning rails 51, 52.

An edge face of the plate 53 is fastened to the front main face of the base 56 so that the plate 53 extends perpendicularly to the base 56. A projection 58 is fastened to the plate 53 and to the base 56 so as to support the fastening between the plate 53 and the base 56.

The bases 56 are suitable for being moved along positioning rails 51, 52 towards or away from the printer units 44 to 50 for printing on the mandrel 8 in the printing position, as a function of the size of the article to be printed.

The printer station 12 has a sheet of optical fibers 78 represented diagrammatically in FIG. 4 only. This sheet of optical fibers 78 is directed towards the mandrel 8. It is suitable for setting the ink printed on the article engaged on the mandrel 8.

The optical fibers 78 are mounted on a support (not shown) carried by the plate 42. They are suitable for being displaced by displacement means 80 between a drying position in which the optical fibers 78 face the mandrel 8 when it is placed in the printing position, on its side opposite from the range of positions for the print heads 44 to 50, and an away-from-drying position in which the optical fibers 78 are spaced apart from the mandrel 8 so as to allow it to be moved towards the axis of rotation A-A of the turntable 6.

The printer station 12 also has a control unit 82 connected to each printer unit 44 to 50 in order to control the triggering thereof. The control unit 82 has connector means for connecting to the motor and gearbox units 120 and 122 for receiving position and speed information relating to the mandrel 8.

The printer station 12 also has a first encoder 124 shown in FIG. 3 that is connected to the control unit 82 and that is mounted facing the drive shaft 123 of the motor 122 in order to determine the outlet speed of said drive shaft 123.

During a calibration stage, the printer station 12 also includes a processor unit 125 that is connected to the first encoder 124 and to a second encoder 126.

The second encoder 126 is mounted facing the article for printing in order to determine the peripheral speed of rotation of the mandrel 8.

The processor unit 124 is suitable for receiving pulses representative of the speed of the drive shaft 123 from the first encoder 124, and pulses representative of the peripheral speed of rotation of the mandrel 8 from the second encoder 126.

The processor unit 125 is suitable for verifying whether the peripheral speed of rotation of the mandrel 8 is constant by measuring the frequency difference of the pulses emitted by the encoders 124 and 126. When the center of the pair of follower wheels 104 is not exactly positioned in a predefined location of the pair of grooves 106, the shaft 102 for driving the mandrel in rotation is not exactly in register with the drive shaft of the guide 108, and as a result the speed of rotation of the mandrel 8 varies as a function of time.

The processor unit is suitable for correcting these speed variations associated with the difficulty of positioning the pair of follower wheels 108 accurately in the groove 106 by controlling the motor 122 so as to modify the speed of its drive shaft 123 so that the speed of the mandrel 8 is constant.

Once the mandrel has been calibrated, the correction that is characteristic for each of the mandrels of the turntable 6 is adjusted once and for all, and consequently the processor unit 125 and the second encoder 126 are disconnected from the printer station.

The control unit 82 is suitable for receiving data representative of the pattern to be printed on the articles, data representative of the diameters of the articles, data relating to the peripheral speed of rotation of the mandrel 8 carrying the article for printing as received from the second encoder 126, said mandrel being in the printing position, and radial position data (relative to the axis A-A) concerning the mandrel and received from position-identifying means, not shown.

The control unit 82 is suitable for causing ink to be projected from each printer unit 44 to 50 as a function of the position of the mandrel 8 and thus of the article situated on the mandrel 8, and also of the speed of rotation of the mandrel 8 during printing, as explained in the description below.

The control unit 82 is also connected to means for causing the optical fibers 78 to deliver radiation and for controlling the means 80 for displacing the optical fibers 78 so as to cause the inks printed on the articles to be dried, as explained below.

The operation of the machine 2, and in particular of the rotary drive means 23, 33 and of the turntable 6 is known and is described in particular in patent application FR 2 860 180.

In operation, during a transfer step, the turntable 6 is caused to turn so as to bring a mandrel 8 into register with the printer station 12. The mandrel 8 is then in a transfer position in which the corresponding carriage 24 is placed close to the axis of rotation A-A of the turntable 6.

Thereafter, the carriage 24 is moved away from the axis A-A towards the printer station 12 until the mandrel 8 in question is in the printing position. The axis of rotation B-B of the mandrel 8 is then at the center of the circle C-C.

Figure 5:
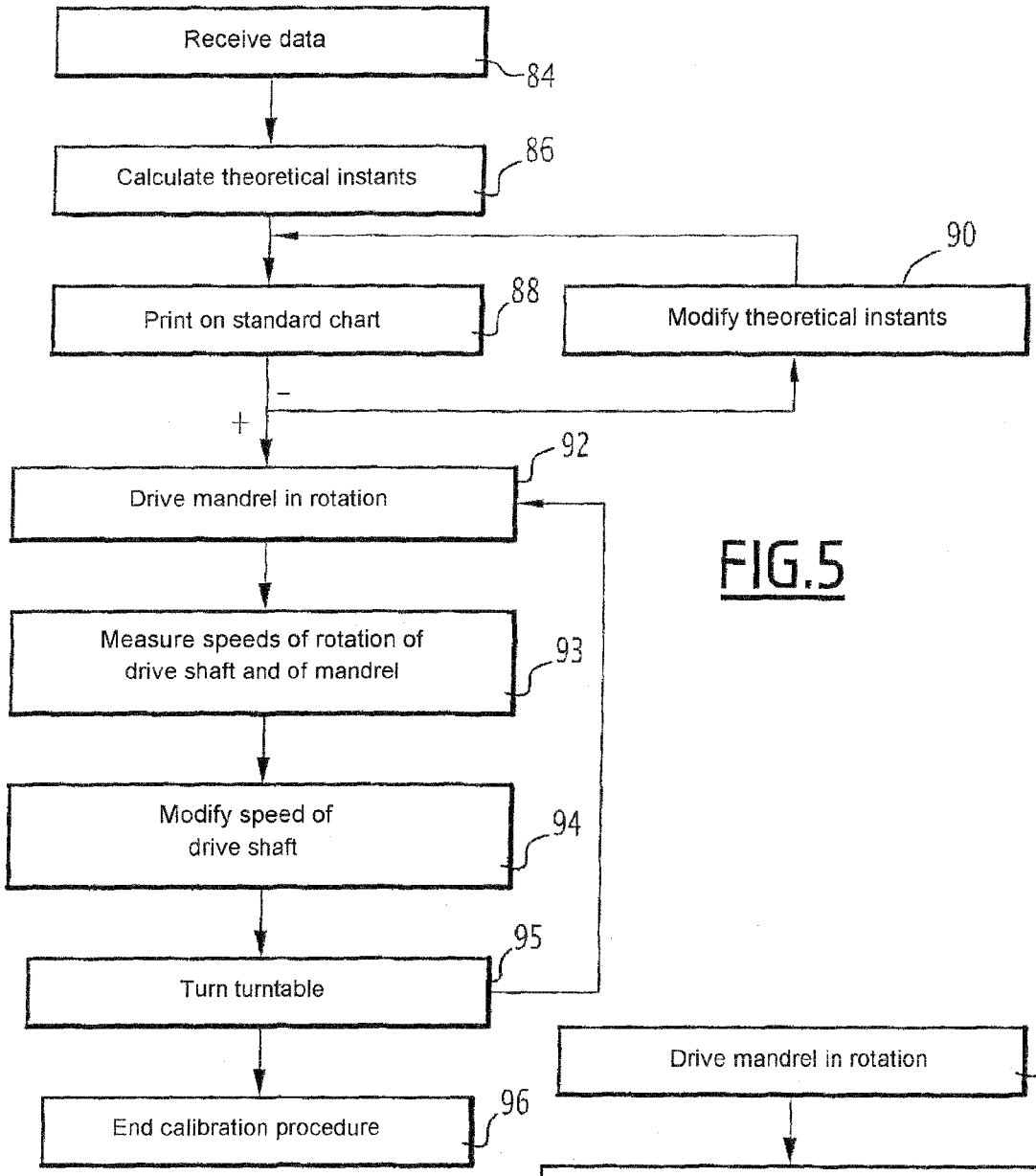
FIG. 5 is a flow chart showing the steps of a method of calibrating the FIG. 1 machine.

When the printing machine 2 prints articles of a defined size for the first time, the control unit 82 is suitable for implementing a prior calibration method as shown in FIG. 5.

During an initial step 84, the control unit 82 receives data representative of the diameter of articles for printing, data representative of the pattern to be printed, position data, and speed of rotation data relating to the mandrel 8 placed in the printing position.

During a step 86, the control unit 82 calculates the instants when each of the printer units 44 to 50 ought theoretically to be triggered as a function of the pattern to be printed, on the basis of the position and the speed of rotation of the mandrel 8.

Simultaneously, an operator positions the bases 56 on the positioning rails 51, 52 so that the printer units 44 to 50 are at a predefined distance from the article for printing. The operator also adjusts the orientation of each print head 54 by operating the micrometer screws 74, 75.

The operator then installs a standard, sometimes known as a "test chart", on the mandrel 8.

During a step 88, the control unit 82 transmits to each printer unit 44 to 50 the theoretical instants for triggering each printer unit. Thereafter, each printer unit 44 to 50 prints a series of test lines on the standard.

Since each print head 54 is fed with ink of a different color, each series of lines is printed in a different color. The operator removes the standard from the mandrel and verifies whether the lines of printing correspond to calibration lines already marked on the standard.

When the lines printed by a printer unit 44 do not correspond to the calibration lines, the operator modifies the theoretical instance for triggering said printer unit 44 by inputting correction data into the control unit 82, during a step 90.

The steps 88 and 90 are repeated until all of the lines printed by each of the printer units 44 to 50 do indeed correspond to the calibration lines.

Once the lines printed by each printer unit 44 to 50 do indeed correspond to the calibration lines, the mandrel 8 previously placed in the printing position is driven in rotation during a step 92.

During a step 93, the encoders 124 and 126 measure the speed of rotation of the drive shaft 123 and the peripheral speed of rotation of the mandrel 8.

During a step 94, the processor unit 125 compares the speed of rotation of the drive shaft 123 with the peripheral speed of rotation of the mandrel 8. When the instantaneous speeds of the shaft 123 and of the mandrel 8 are different, i.e. when the peripheral speed of the mandrel is not constant, the processor unit 125 calculates a model of the variations that could be imparted to the speed of the drive shaft 123 to cause the peripheral speed of the mandrel 8 to be constant, and it controls the motor 122 as a function of the model.

During a step 95, the turntable 6 is turned clockwise about the axis A-A so as to bring the mandrel 8 of the support carriage 24 placed in register with the treatment station 10 into register with the printer station 12. Thereafter, the mandrel 8 is moved away from the axis A-A so as to reach the printing position in which the axis of rotation B-B of the mandrel 8 coincides with the center of the circular arc C-C.

Steps 92 to 95 are repeated to adjust the peripheral speed of rotation of each of the mandrels 8 on the turntable 6.

Once the peripheral speed of rotation of each of the mandrels 8 of the turntable 6 is constant, the calibration method is terminated in a step 96. The processor unit 125 is disconnected from the first encoder 124. This encoder together with the second encoder 126 are no longer used while printing on articles.

The machine 2 then proceeds with printing articles.

Figure 6:
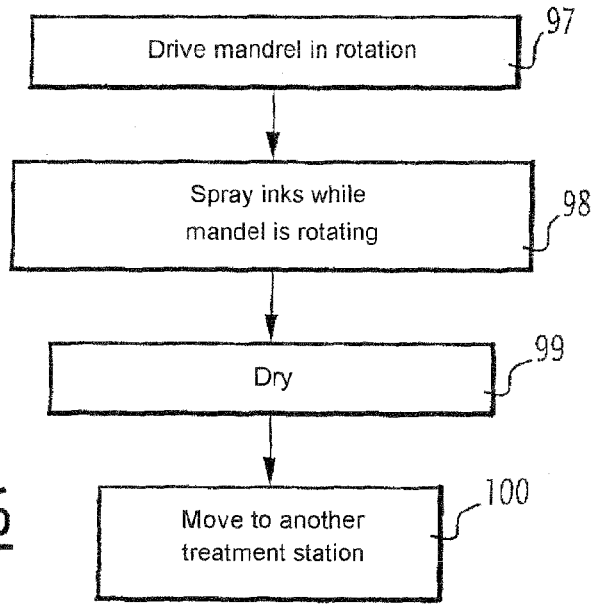
FIG. 6 is a flow chart showing the steps of the printing method.

During this printing method, the mandrel 8 previously placed in the printing position is driven in rotation during a step 97 shown in FIG. 6.

During a step 98, the printer units 44, 46, 48, and 50 are triggered in succession at the theoretical triggering instants or at the corrected triggering instants in order to project ink onto the article carried by the mandrel 8 that is being driven in rotation.

During a step 99, the control unit 82 controls the displacement means 80 to cause the optical fibers to be positioned in register with the mandrel 8. Thereafter, the control unit 82 causes radiation to be delivered by the optical fibers 78 to set the inks printed on the article.

During steps 97 to 99, the mandrel is not moved in translation towards the axis A-A, and is merely driven in rotation about the axis B-B.

At the end of step 99, i.e. when all of the surface of the article has faced the optical fibers 78 at least once, the control unit 82 causes the displacement means 80 to move the optical fibers away from their position in register with the mandrel 8.

During a step 100, the displacement means 42 move the mandrel 8 towards the axis of rotation A-A into a transfer position. Then, the turntable 6 is turned to bring the mandrel 8 towards the following treatment station 14. Another mandrel is placed facing the station 12 and is then placed in the printing position. The printing method can then be implemented again.

The machine 2 described above enables printing to be very accurate since the mandrels 8 are not moved in translation from one printer station to another. Each article is printed in a plurality of colors while it is positioned in a single location and while it is revolving. The machine 2 enables throughput to be increased since each article is dried once only, after all four colors have been printed.

In addition, the machine 2 achieves a saving in space around the perimeter of the turntable 6 since there is no longer any need to provide a station that is dedicated specifically to drying.

Finally, accuracy of the order of 0.01 millimeters can be obtained with the printer station of the invention, regardless of the diameter of the article.

In general, the mandrels can be moved from their printing positions to their transfer positions by means other than a turntable. By way of example, the mandrels could be moved in translation by a conveyor.

In a variant, instead of having ink jet print heads, the printer units could have marker print heads.

In a variant, the speed of each mandrel 8 is not determined by the encoders 124 and 126 and the processor unit 125, but by injecting a speed profile into the motor 122.

Also in a variant, the first and second encoders 124 and 126 are connected to the control unit 82 which verifies whether the peripheral speed of rotation of the mandrels is constant by measuring the frequency difference of pulses emitted by the encoders 124 and 126. Under such circumstances, there is no need to use a processor unit.

In certain variants it should be observed that the machine 2 may include a plurality of printer stations 12, each having a plurality of printer units. Even if the preferred variant has only one printer station, such variants already make it possible to benefit from the abovementioned advantages compared with prior art machines.

It is possible to provide a printer station in which the peripheral speed of the mandrel is not adjusted to the speed of rotation of the mandrel drive shaft, for example when the mandrel drive device does not include a crank.

The invention claimed is:

1. A printing machine for printing articles that are substantially in the form of bodies of revolution, the machine comprising:

a structure;

mandrels for carrying articles for printing, each mandrel being suitable for being driven in rotation about an axis of rotation corresponding substantially to an axis of symmetry of the article for printing;

drive means for driving the article for printing so as to cause the mandrels to be moved between transfer positions and at least one printing position;

a turntable carrying the mandrels, the turntable being driven in rotation by the drive means;

displacement means for moving the mandrels in a radial direction relative to the turntable to move the mandrels away from or towards a printer station, each mandrel being moved between transfer positions and at least one printing position; and the printer station comprising a support plate and a printer unit fastened to the support plate to project ink onto the articles for printing;

wherein the printer station includes at least one additional printer unit, and the printer units are arranged beside one another around a semi-circle centered on the axis of rotation of the mandrel, a diameter of said semi-circle, passing by the ends of said semi-circle, being perpendicular to the radial direction, when the mandrel is placed in its printing position.

2. The printing machine according to claim 1, wherein the printing machine further includes a control unit suitable for calculating theoretical instants for triggering the projection of ink from each printer unit onto an article as a function of data representative of a pattern for printing on said article, of the size of said article, and of a position and a speed of rotation of the mandrel carrying said article.

3. The printing machine according to claim 2, wherein the control unit includes manual adjustment means for adjusting the theoretical instants at which ink is projected from each printer unit.

4. The printing machine according to claim 2, further including:

drive means provided with a drive shaft for driving each mandrel in rotation;

transmission means for transmitting the rotation of the drive shaft to the mandrel;

a first encoder suitable for determining a speed of the drive shaft;

at least one second encoder suitable for determining a peripheral speed of rotation of the mandrel when driven in rotation; and a processor unit suitable for comparing the speed of the drive shaft with the peripheral speed of the mandrel and for modifying the speed of the drive shaft as a function of the peripheral speed of the mandrel so that the peripheral speed of the mandrel is constant.

5. The printing machine according to claim 1, further including drier means suitable for setting the ink printed on the articles, and the drier means are arranged facing a mandrel while the mandrel is placed in the printing position.

6. The printing machine according to claim 5, wherein the drier means comprise at least one optical fiber.

7. The printing machine according to claim 5, further including displacement means for displacing the drier means in a direction that is linear relative to said semi-circle.

8. The printing machine according to claim 1, wherein the printing machine has a single printer station.

9. The printing machine according to claim 1, wherein all of the printer units of the printer station face the same mandrel, and in that the printer units are suitable for printing on the article carried by said mandrel, the mandrel being positioned in the same location while the printer units are printing on the article.

10. A method of printing on articles presenting substantially the shape of a body of revolution, with the help of a printing machine according to claim 1, the method comprising:

a step of printing and simultaneously driving the mandrel in rotation about its axis of rotation by drive means, said mandrel being positioned in the same location while it is pivoting in a printing position, and an article for printing carried by said mandrel being printed on by said printer units.

11. The printing method according to claim 10, further comprising:

a step of drying the ink while the mandrel is located in the printing position.

12. The printing method according to claim 10, further comprising: the following steps prior to the step of printing and driving the mandrel in rotation:

installing a standard on said mandrel;

triggering the projection of ink by each printer unit onto said standard;

visually inspecting the standard; and adjusting the theoretical instants for triggering the projection of ink by each printer unit, said adjustment being made on the basis of the visual inspection of the standard.

13. The printing method according to claim 10, further comprising the following steps, prior to the step of printing and driving the mandrel in rotation:

using a first encoder for measuring the speed of a drive shaft of the means for driving each mandrel in rotation;

using a second encoder for measuring the peripheral speed of rotation of the mandrel; and adjusting a speed of the drive means for driving the drive shaft as a function of a peripheral speed of the mandrel so that the peripheral speed of the mandrel is constant.

14. A printing machine for printing articles that are substantially in the form of bodies of revolution, the machine comprising:

a structure;

a plurality of mandrels for carrying articles for printing, each mandrel being adapted for being driven in rotation about an axis of rotation corresponding substantially to an axis of symmetry of the article for printing;

a rotary drive configured for driving the article for printing so as to cause the mandrels to be moved between transfer positions and at least one printing position;

a turntable carrying the mandrels, the turntable being driven in rotation by the drive;

slideways and guide rails configured for moving the mandrels in a radial direction relative to the turntable to move the mandrels away from or towards a printer station, each mandrel being moved between transfer positions and at least one printing position; and the printer station comprising a support plate and a printer unit fastened to the support plate to project ink onto the articles for printing;

wherein the printer station includes at least one additional printer unit, and the printer units are arranged beside one another around a semi-circle centered on the axis of rotation of the mandrel, a diameter of said semi-circle, passing by the ends of said semi-circle, being perpendicular to the radial direction, when the mandrel is placed in its printing position.

15. The printing machine according to claim 14, wherein the printing machine further includes a control unit suitable for calculating theoretical instants for triggering the projection of ink from each printer unit onto an article as a function of data representative of a pattern for printing on said article, of the size of said article, and of a position and a speed of rotation of the mandrel carrying said article.

16. The printing machine according to claim 15, wherein the control unit is configured to manually adjust the theoretical instants at which ink is projected from each printer unit.

17. The printing machine according to claim 15, further including:

a motor provided with a drive shaft for driving each mandrel in rotation;

a transmission configured to transmit the rotation of the drive shaft to the mandrel;

a first encoder suitable for determining a speed of the drive shaft;

at least one second encoder suitable for determining a peripheral speed of rotation of the mandrel when driven in rotation; and a processor unit suitable for comparing the speed of the drive shaft with the peripheral speed of the mandrel and for modifying the speed of the drive shaft as a function of the peripheral speed of the mandrel so that the peripheral speed of the mandrel is constant.

18. The printing machine according to claim 14, further including a drier configured for setting the ink printed on the articles, and the drier is arranged facing the mandrel while the mandrel is placed in the printing position.

19. The printing machine according to claim 18, wherein the drier comprises at least one optical fiber.

20. The printing machine according to claim 18, further including a displacement device configured for displacing the drier in a direction that is linear relative to said circle.

* * * * *